US006851986B2

(12) United States Patent
Zhao

(10) Patent No.: US 6,851,986 B2
(45) Date of Patent: Feb. 8, 2005

(54) BATTERY TO CIRCUIT BOARD ELECTRICAL CONNECTOR

(75) Inventor: Lei Zhao, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/444,689

(22) Filed: May 23, 2003

(65) Prior Publication Data

US 2003/0228804 A1 Dec. 11, 2003

(30) Foreign Application Priority Data

May 24, 2002 (TW) ..... 91207628 U

(51) Int. Cl.[7] ..... H01R 13/428; H01R 13/40
(52) U.S. Cl. ..... 439/744; 439/733.1; 439/595
(58) Field of Search ..... 439/66, 81, 74, 439/733.1, 752, 744, 595

(56) References Cited

U.S. PATENT DOCUMENTS 4,275,944 A * 6/1981 Sochor ..... 439/267
4,491,378 A * 1/1985 Crawford ..... 439/325
5,224,866 A * 7/1993 Nakamura et al. ..... 439/81
5,259,769 A * 11/1993 Cruise et al. ..... 439/65
5,496,180 A * 3/1996 Fabian et al. ..... 439/60
5,605,476 A * 2/1997 McNamara et al. ..... 439/608
6,135,805 A * 10/2000 Sowinski ..... 439/402
6,253,451 B1 * 7/2001 Semmeling et al. ..... 29/842
6,319,075 B1 * 11/2001 Clark et al. ..... 439/825
6,478,594 B1 * 11/2002 Curtin et al. ..... 439/188
2003/0224632 A1 * 12/2003 Regnier et al. ..... 439/79

* cited by examiner

*Primary Examiner*—Chandrika Prasad
(74) *Attorney, Agent, or Firm*—Stephen Z. Weiss

(57) ABSTRACT

An electrical connector includes a dielectric housing having first and second spaced-apart faces with at least one terminal-receiving passage communicating between the faces. The passage includes a terminal mounting portion and a terminal securing portion. A conductive terminal is received in at least one of the passages and includes a body portion for engaging the terminal mounting portion of the passage. The terminal includes a first contact portion extending from one side of the body portion for establishing electrical connection with a first electrical device at the first face of the housing. The terminal includes a second contact portion extending from a second side of the body portion for establishing an electrical connection with a second electrical device at the second side of the housing. The terminal includes a securement portion for engaging the terminal securing portion of the passage.

8 Claims, 5 Drawing Sheets

FIG.5
(PRIOR ART)
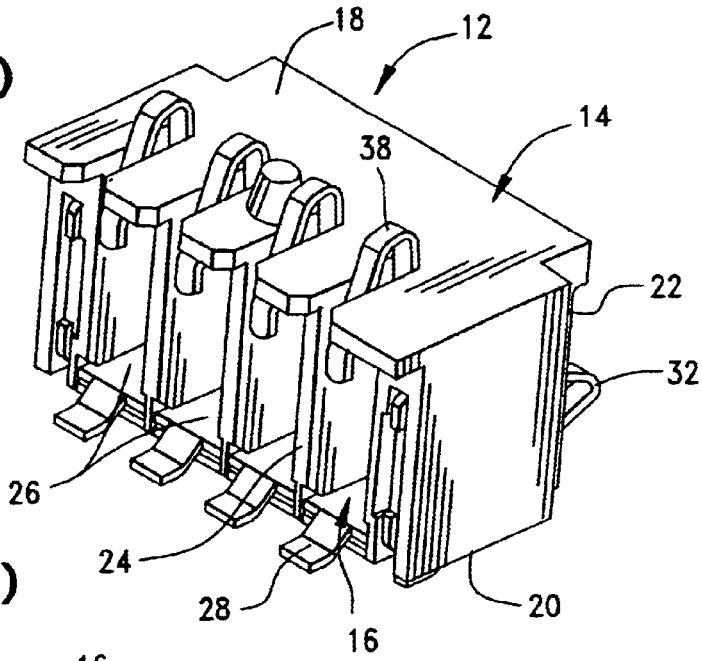
FIG.6
(PRIOR ART)
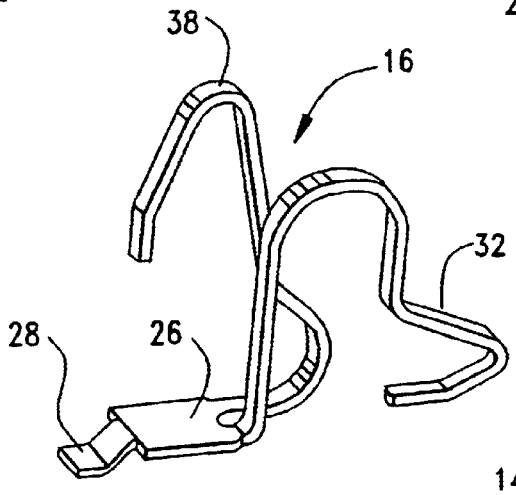
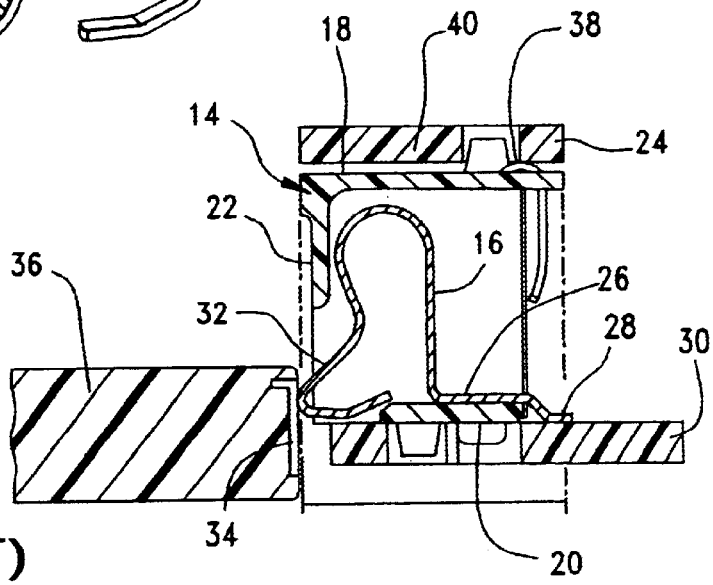
FIG.7
(PRIOR ART)

BATTERY TO CIRCUIT BOARD ELECTRICAL CONNECTOR

FIELD OF THE INVENTION

This invention generally relates to the art of electrical connectors and, particularly, to a vertical type battery connector for use in various electronic devices such as a conventional mobile phone.

BACKGROUND OF THE INVENTION

For instance, FIGS. 5, 6 and 7 show a vertical type battery connector as is disclosed in Taiwanese Patent Application No. 88100725, filed Jan. 18, 1999. The connector, generally designated 12, includes a dielectric or insulative housing, generally designated 14, which mounts a plurality of conductive terminals, generally designated 16 and one of which is shown in FIG. 16. The housing includes a top wall which defines a top circuit board mounting face 18, a bottom wall which defines a bottom circuit board mounting face 20, a front connecting face 22 and a rear terminating face 24. Each conductive terminal 16 includes a main body 26 having a first contact portion 28 extending from one side thereof and outwardly of rear terminating face 24 of the housing for connection to an appropriate circuit trace on a circuit board 30 (FIG. 7). A second contact portion extends from an opposite side of main body 26 and outwardly of front connecting face 22 of the housing for electrical connection to an appropriate contact 30 of an electronic device such as a battery 36 (FIG. 7). In this particular connector construction, a third contact portion 38 projects upwardly from main body 26 for engaging an appropriate circuit trace on the underside of a second circuit board 40 (FIG. 7).

In battery connection 12 of FIGS. 5–7, it can be seen that first contact portions 28 of terminals 16 project outwardly of rear terminating face 24 of the housing for electrical connection to circuit board 30, while second contact portions 32 of the terminals project from the opposite or front connecting face 22 of the housing for electrical connection to battery 36. This arrangement of the contact portions of the terminals which results in a connecting width "W2" for the battery connector between first and second contact portions 28 and 32, respectively, between circuit board 30 and battery 36. With the ever-increasing miniaturization of electrical equipment such as mobile telephones, attempts constantly are being made in the industry to reduce these connecting widths.

FIGS. 8, 9 and 10 show a vertical type battery connector, generally designated 40, as is disclosed in Taiwanese Utility Model Patent Application No. 91200828 which was filed on Jan. 28, 2002. In this disclosure, battery connector 40 includes a dielectric housing, generally designated 42, which mounts a plurality of conductive terminals, generally designated 44.

Dielectric housing 42 of battery connector 40 includes a plurality of upright walls 46 extending upwardly from an upper surface of a bottom wall 48. Upright walls 46 are spaced from each other and adjacent pairs of the upright walls form a plurality of terminal-receiving passages 50. A front wall 52 is further formed with openings 54 aligned with terminal-receiving passages 50 so that the passages extend through the front and rear ends thereof. Opposing wall surfaces 56 and 58 of upright walls 46 of each terminal-receiving passage 50 have retaining blocks 60 projecting into passages 50 at positions adjacent a bottom wall 62 of each passage 50 and spaced therefrom. The opposing retaining blocks do not touch each other within each passage as can be seen in FIG. 9, and the retaining blocks are spaced above a bottom wall 62 (FIG. 9) of the respective passage to form a retaining groove 64 as seen in FIG. 10. In addition, a lower surface of bottom wall 48 of the housing is formed with a plurality of downwardly extending partition plates 66 vertically aligned with upright walls 46 to form limiting grooves 68 vertically aligned with terminal-receiving passages 50. Finally, a positioning block projects outwardly from each opposite end of the housing so that the positioning blocks can be used to position battery connector 40 relative to an appropriate mating connecting device.

Each conductive terminal 44 received in a respective one of the terminal-receiving passages 50 in housing 42 is stamped and formed of conductive sheet metal material and includes a main body 72, a first contact portion 74 and a second contact portion 76.

Main body 72 of each terminal 44 is a generally rectangular plate having a first side 72*a* and a second side 72*b*. First contact portions 74 extends obliquely downwardly and then obliquely upwardly from first side 72*a* to form a hook configuration 74*a* of first contact portion 74 for electrically engaging circuit board 30. Second contact portion 76 is formed in the shape of a U-shaped elastic arm 76*a* defined by a pair of opposing legs 76*b* of the U-shaped configuration. Elastic arm 76*a* projects from second side 72*b* of main body 72 and outwardly of the terminating face of the connector whereby second contact portion 76 can electrically engage contacts 34 (FIG. 10) of battery 36. Finally, the distal end of elastic arm 76*a* is provided with a retaining hook 76*c* which abuts against a back side 52*a* of front wall 52 of the housing.

During assembly of battery connector 40, conductive terminals 44 are inserted into terminal-receiving passages 50 in the direction of arrow "A" (FIG. 10) until main bodies 72 of the terminals are secured within retaining grooves 64 of the housing. At full assembly, retaining hooks 76*c* of the terminals engage back sides 52*a* of front wall 52. It can be seen that the only mounting, retaining or securing means for the entirety of each terminal 44 is at the single main body 72 of the terminal. This retention is achieved solely by the interference fit of main bodies 72 of the terminals. After assembly, contacts 34 of a battery 36 may be appropriately engaged with contact portions 76 of terminals 44 if the battery is engaged in the direction of arrow "B" (FIG. 10). However, difficulties may be encountered if the battery is moved into engagement in the direction of arrow "C".

SUMMARY OF THE INVENTION

An object, therefore, of the invention is to provide a new and improved electrical connector of the character described.

Another object of the invention is to provide a battery connector of the character described, including the provision of improved contact engagement and/or improved terminal retention.

In the exemplary embodiment of the invention, the connector includes a dielectric housing having first and second spaced-apart faces with at least one terminal-receiving passage communicating between the faces. The passage includes a terminal mounting portion and a terminal securing portion. A conductive terminal is received in the at least one terminal-receiving passage and includes a body portion for engaging the terminal mounting portion of the passage. A first contact portion extends from one side of the body portion for establishing electrical connection with a first electrical device at the first face of the housing. A second contact portion extends from a second side of the body portion for establishing electrical connection with a second electrical device at the second side of the housing. A securement portion is provided for engaging the terminal securing portion of the passage.

As disclosed herein, the conductive terminal is stamped and formed of sheet metal material. The first and second faces of the dielectric housing are generally perpendicular to each other. The first contact portion of the conductive terminal projects from the first face of the housing and is adapted for establishing electrical connection with a circuit board. The second contact portion of the conductive terminal projects from the second face of the housing and is adapted for establishing electrical connection with a contact of a battery.

According to further aspects of the invention, the terminal mounting portion of the housing and the body portion of the terminal have complementary interengaging interference means to hold the terminal to the housing. In addition, the terminal securing portion of the housing and the securement portion of the terminal have complementary interengaging interference means to hold the terminal to the housing. The complementary interengaging interference means between both the terminal mounting portion of the housing and the body portion of the terminal as well as the terminal securing portion of the housing and the securement portion of the terminal are arranged for interengagement by inserting the entire terminal into the one terminal-receiving passage from one common face of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIGS. 5–7 are views of a prior art battery connector as described in the "Description of the Prior Art", above.

DETAILED DESCRIPTION OF THE PREFERRED EMBODIMENT

Figure 1:
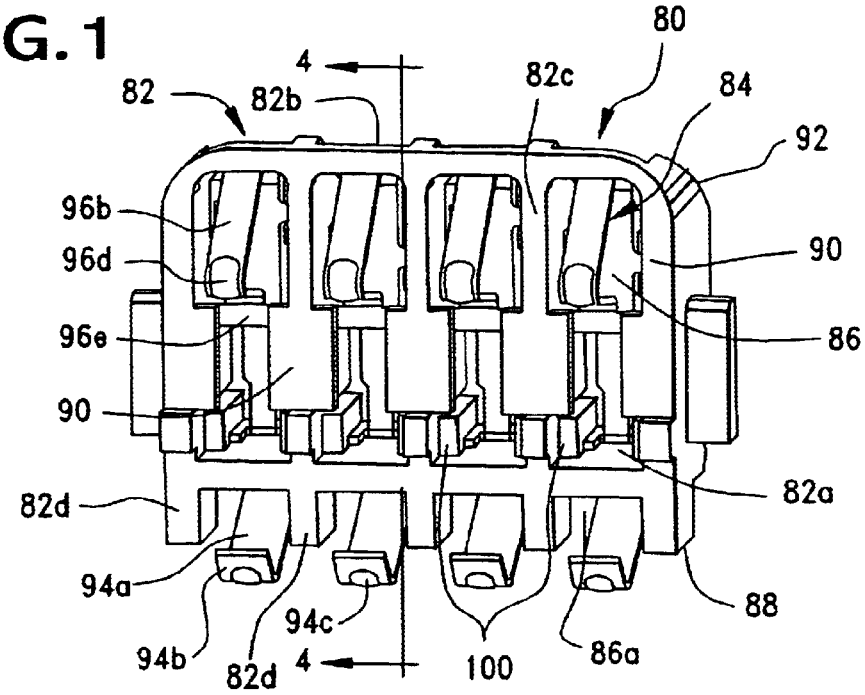
FIG. 1 is a perspective view looking at the front or terminating face of a battery connector embodying the concepts of the invention.

Referring now to FIGS. 1–4, the invention is embodied in an electrical connector in the form of a battery connector, generally designated 80, which includes a dielectric or insulative housing, generally designated 82, that adapted to be mounted on a circuit board 83 (FIG. 4) of a mobile phone to establish electrical connection with corresponding contacts and to establish electrical connection with a battery 36 (FIG. 4) used by the mobile phone. The housing mounts a plurality of conductive terminals, generally designated 84, which are stamped and formed of conductive sheet metal material.

Housing 82 of battery connector 80 may be a one-piece structure unitarily molded of dielectric material or the like. The housing includes a bottom wall 82*a*, a top wall 82*b* and a plurality of parallel upright walls 82*c* which form a plurality of parallel spaced-apart terminal-receiving passages 86. The housing has a plurality of posts 82*d* which project downwardly below bottom wall 82*a* and are in alignment with upright walls 82*c* of the housing. In essence, posts 82*d* form passage extensions 86*a* in alignment with terminal-receiving passages 86 for positioning or receiving portion of the terminals as described hereinafter.

Figure 4:
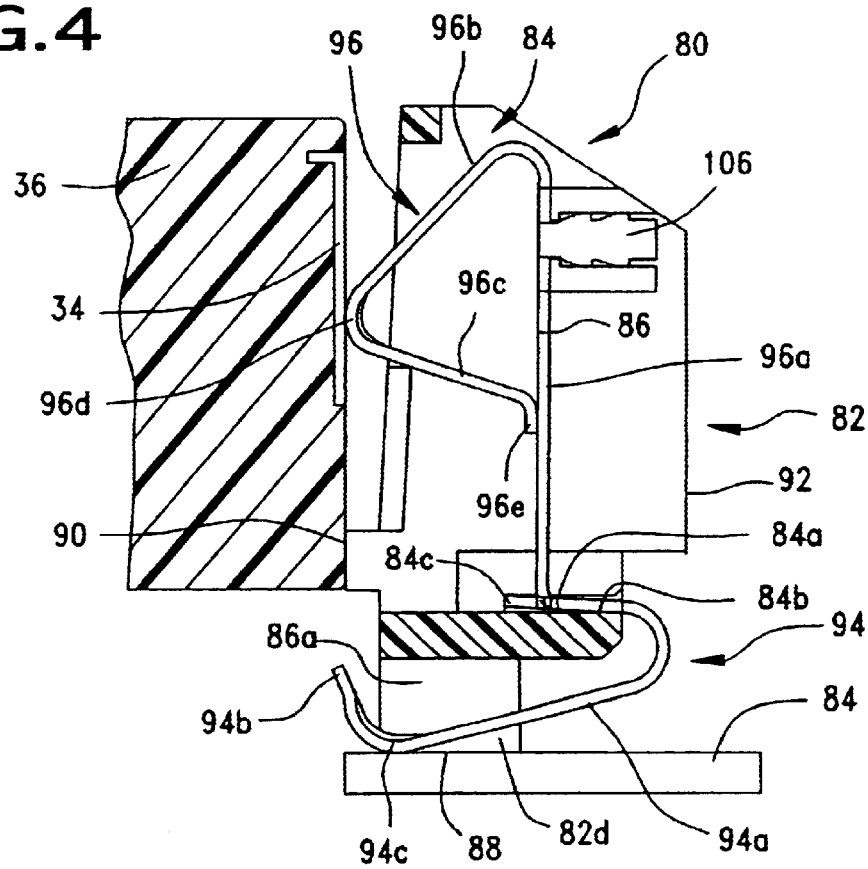
FIG. 4 is a vertical section, on an enlarged scale, taken generally along line 4—4 of FIG. 1.
Figure 8:
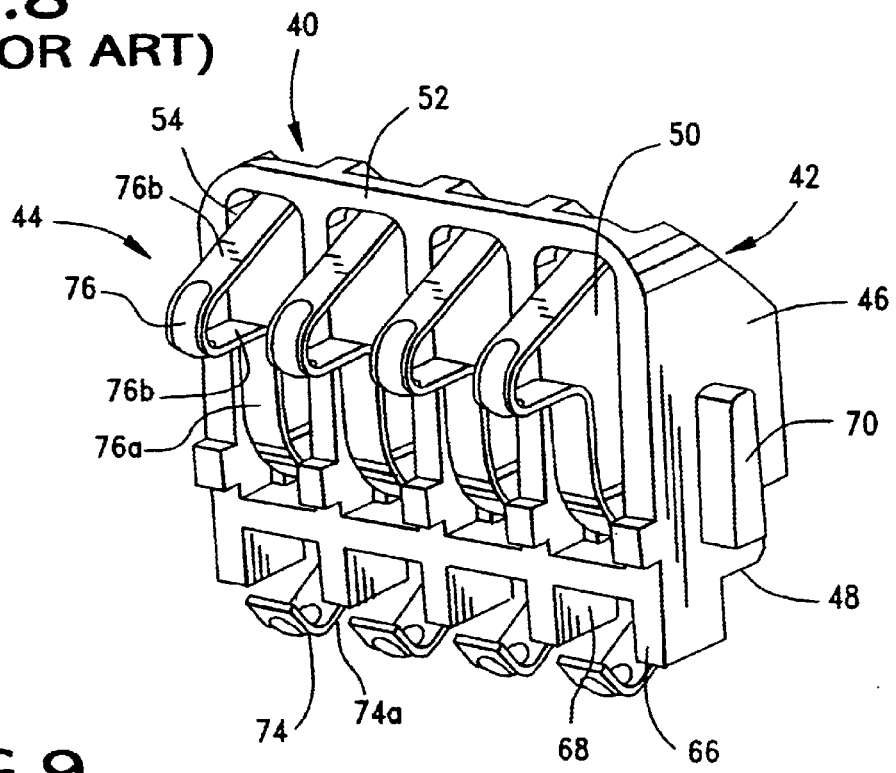
FIG.8 (PRIOR ART)
FIGS. 8–10 are views of another embodiment of a prior art battery connector as described in the "Description of the Prior Art", above.
Figure 9:
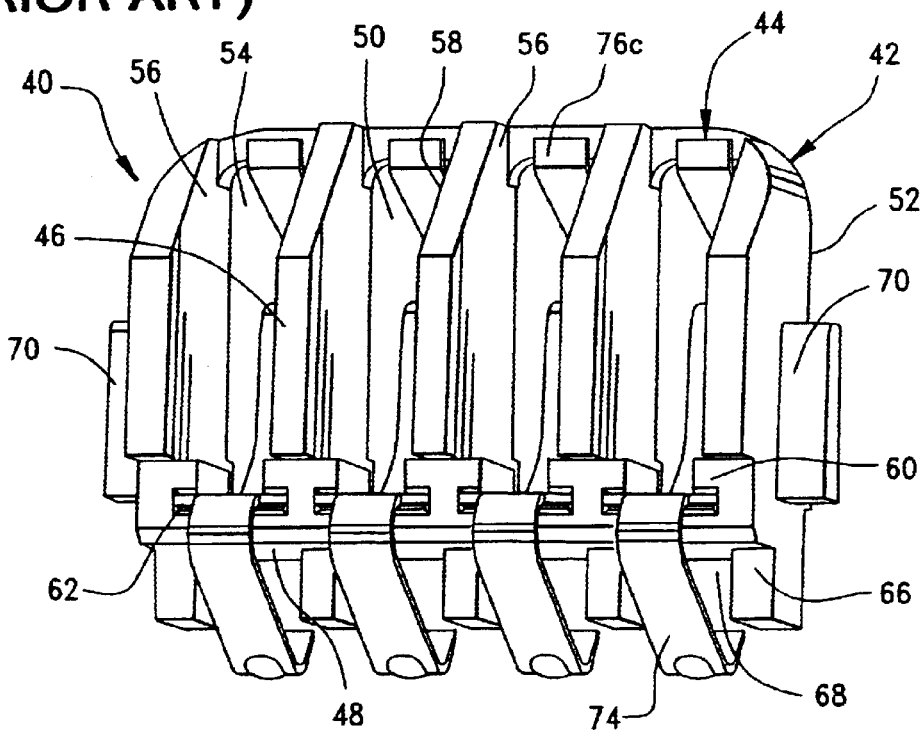
FIG.9 (PRIOR ART)
Figure 10:
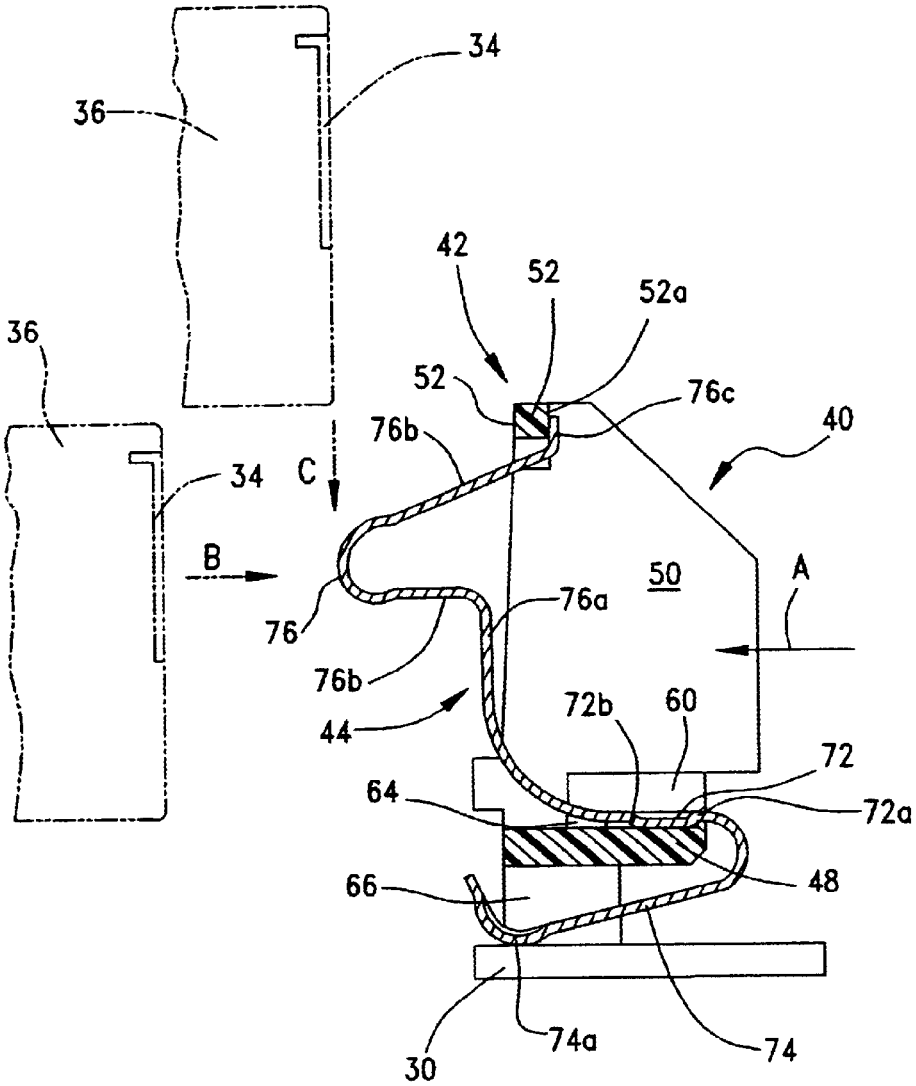
FIG. 10 (PRIOR ART)

In essence, housing 82 of battery connector 80 defines a first or bottom face 89 at the bottom of posts 82*d* for engaging circuit board 83 (see FIG. 4). The housing also defines a second or front face 90 as well as a rear face 92. Battery 36 is electrically connected to the connector at the second or front face 90 as seen in FIG. 4.

Each conductive terminal 84 of battery connector 80 includes a main body 84*a* having a first side 84*b* and a second side 84*c* opposite the first side. A first contact portion, generally designated 94, is bent back forwardly from a first end of main body 84*a* in the form of a hook and has a downwardly slanting first portion 94*a* and an upwardly slanting second portion 94*b* joined at a hooked contact point 94*c* which engages an appropriate circuit trace on circuit board 84 as seen clearly in FIG. 4.

A second contact portion, generally designated 96, extends from a second end of a body portion defined by main body 84*a* for establishing electrical connection with contacts 34 of battery 36 as seen in FIG. 4. More specifically, an upright extension arm 96*a* extends upwardly from the main body 84*a* and is bent back downwardly into a first contact arm 96*b* joined to a second contact arm 96*c* at a convex contact point 96*d* which engages contact 34 of battery 36. Second contact arm 96*c* has a distal end 96*e* which can ride along the surface of extension arm 96*a* as second contact portion 96 is spring loaded by its closed configuration.

Figure 2:
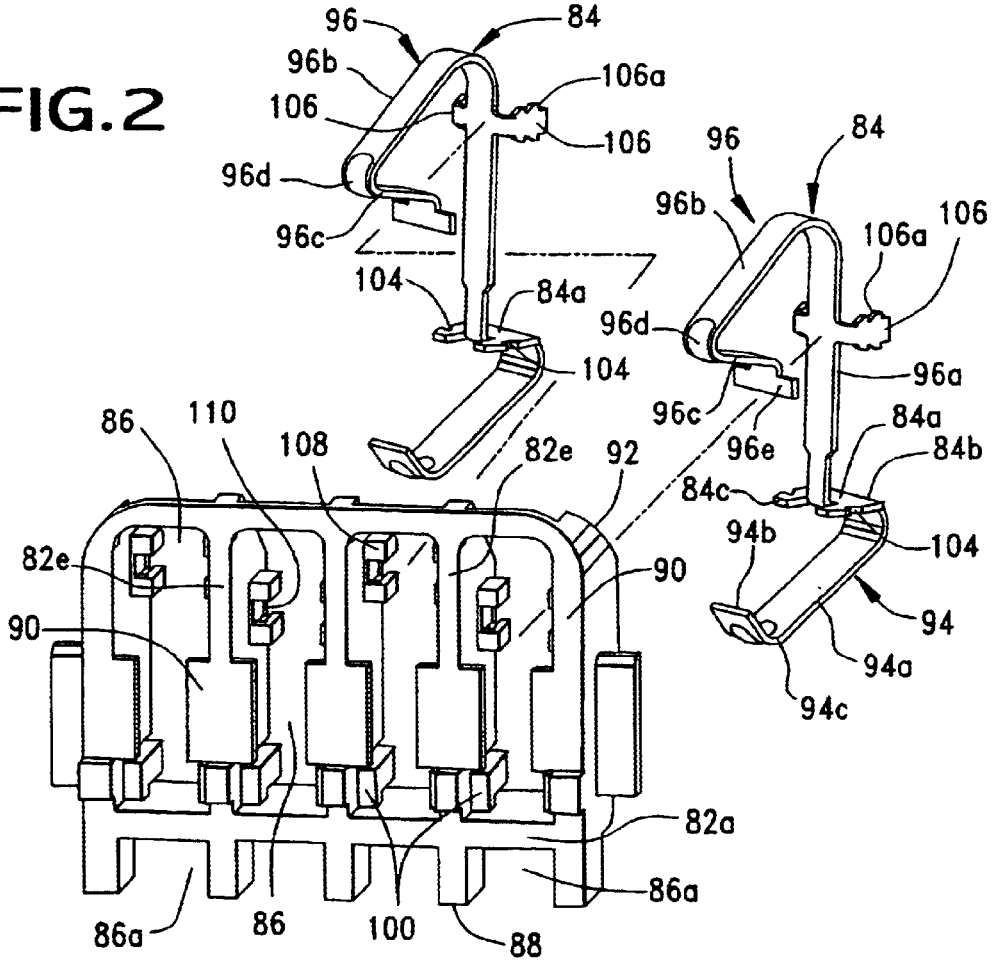
FIG. 2 is a view similar to that of FIG. 1, with two of the terminals shown about to be inserted into the connector housing.
Figure 3:
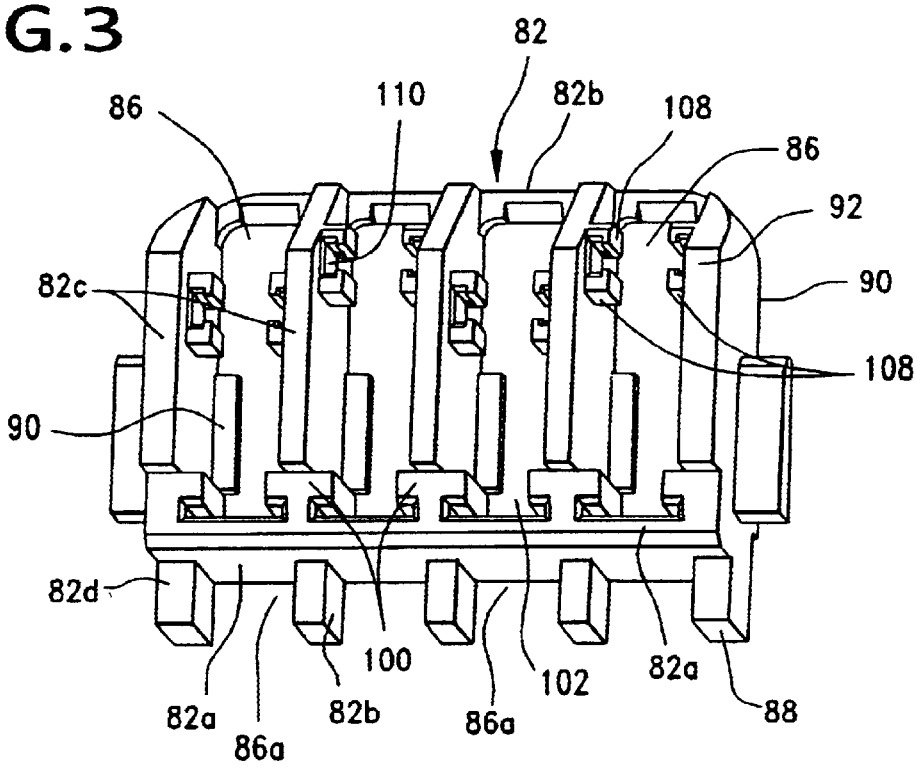
FIG. 3 is a rear perspective view of the connector housing, i.e., opposite the direction of FIG. 2.

Generally, complementary interengaging interference means are provided between main body 84*a* of each terminal 84 and housing 82 to hold the terminal in its respective terminal-receiving passage 86 in the housing. Specifically, housing 82 includes a terminal mounting portion defined by a pair of opposing retaining blocks 100 at the bottom of each terminal-receiving passage 86. Terminals blocks 100 project toward each other and define an inverted T-shaped mounting slot 102 for receiving the main body of the respective terminal, with the extension arm 96*a* of the respective terminal extending from the main body 84*a* upwardly between the retaining blocks joining the body portion to a securement portion, the securement portion being defined by a pair of securement wings 106. As seen in FIG. 2, a plurality of mounting teeth 104 are stamped into the edges of the main body portion of the terminal for skiving into the plastic material of the housing beneath retaining blocks 100 to provide an interference to hold the terminal in the housing.

Generally, complementary interengaging interference means are provided between a pair of securement wings 106 at opposite edges of the extension arm 96*a* of each terminal and a securement block 108 at opposite sides of each terminal-receiving passage 86 of the housing, to hold the respective terminal in the housing. Specifically, each securement block 108 has a slot 110 for receiving one of the securement wings 106 of a respective one of the conductive terminals. Each securement wing 106 is stamped with a plurality of teeth 106*a* along opposite edges thereof for skiving into the plastic material of the housing within grooves 111. A surface of the extension arm 96*a* is located between the opposite edges. Each securement wing 106 extends perpendicular from the edges and the surface. The teeth 106*a* establish an interference fit between the terminal and the housing to hold the terminal in its respective terminal-receiving passages 86 of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing having first and second spaced-apart faces with at least one terminal-receiving passage communicating between the faces, the passage with two sides and including a terminal mounting portion and a terminal securing portion in each side of the passage; and a conductive terminal received in said at least one terminal-receiving passage and including a body portion having a first and second side for engaging the terminal mounting portion of the passage, a first contact portion flexibly extending from one end of the body portion for establishing electrical connection with a first electrical device at said first face of the housing, a second contact portion flexibly extending from a second end of the body portion for establishing electrical connection with a second electrical device at said second side of the housing, and a securement portion, joined to the body portion by an extension arm, and extending perpendicularly from edges of the extension arm and from a surface of the extension arm located between the edges, for engaging the terminal securing portion of the passage, the securement portion of the terminal and the terminal securing portion of the housing passage and the sides of the terminal body portion and the terminal mounting portion of the housing passage having respective complementary interengaging interference means to hold the terminal to the housing.

both of the complementary interengaging interference means are arranged for interengagement by inserting the entire terminal into the at least one terminal receiving passage from one common face of the housing.

2. The electrical connector of claim 1 wherein said conductive terminal is stamped and formed of sheet metal material.

3. The electrical connector of claim 1 wherein said first contact portion of the conductive terminal projects from said first face of the housing and is adapted for establishing electrical connection with a circuit board.

4. The electrical connector of claim 3 wherein said second contact portion of the conductive terminal projects from said second face of the housing and is adapted for establishing electrical connection with a contact of a battery.

5. The electrical connector of claim 1 wherein said first an second faces of the dielectric housing are generally perpendicular to each other.

6. The electrical connector of claim 1 wherein said terminal mounting portion of the housing and said body portion of the terminal have complementary interengaging interference means to hold the terminal to the housing.

7. The electrical connector of claim 1 wherein said one common face of the housing is on a side of the housing opposite said second face thereof.

8. The electrical connector of claim 7 wherein said first and second faces of the dielectric housing are generally perpendicular to each other, with said one common face being generally perpendicular to said first face of the housing.

* * * * *